United States Patent [19]

Marvin

[11] 4,344,427

[45] Aug. 17, 1982

[54] UNDERWATER BREATHING DEVICE

[76] Inventor: Mark C. Marvin, 25 Floral Rd., Peekskill, N.Y. 10566

[21] Appl. No.: 133,336

[22] Filed: Mar. 24, 1980

[51] Int. Cl.[3] ..... B63C 11/00

[52] U.S. Cl. ..... 128/200.25; 128/207.16

[58] Field of Search ..... 128/200.25, 201.11, 128/201.27, 201.28, 203.11, 207.16, 201.25, 200.24, 205.17

[56] References Cited

U.S. PATENT DOCUMENTS

| | | | |
|---|---|---|---|
| 361,925 | 4/1887 | Bruce | 128/201.11 |
| 1,766,300 | 6/1930 | Meredith | 128/201.27 |
| 2,113,779 | 4/1938 | Williamson | 128/201.27 |
| 3,124,124 | 3/1964 | Cross | 128/203.11 |
| 3,286,710 | 11/1966 | Bartlett, Jr. | 128/203.11 |
| 3,895,625 | 7/1975 | DeLest | 128/201.25 |

*Primary Examiner*—Henry J. Recla

[57] ABSTRACT

An underwater breathing device is provided that is capable of separating breathable gas bubbles from water. A collection reservoir, open at one end is capable of collecting gas and conducting it through a one-way valve to the operator. The one-way valve is provided to conduct exhaled gas to the outside and to prevent it from being exhaled into the collection reservoir.

3 Claims, 5 Drawing Figures

Fig. 1
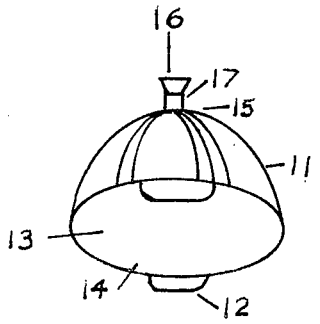
Fig. 2
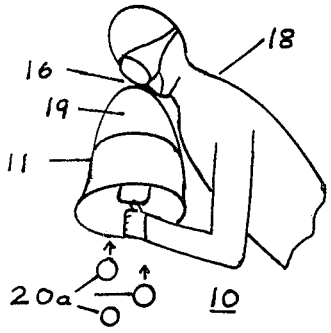
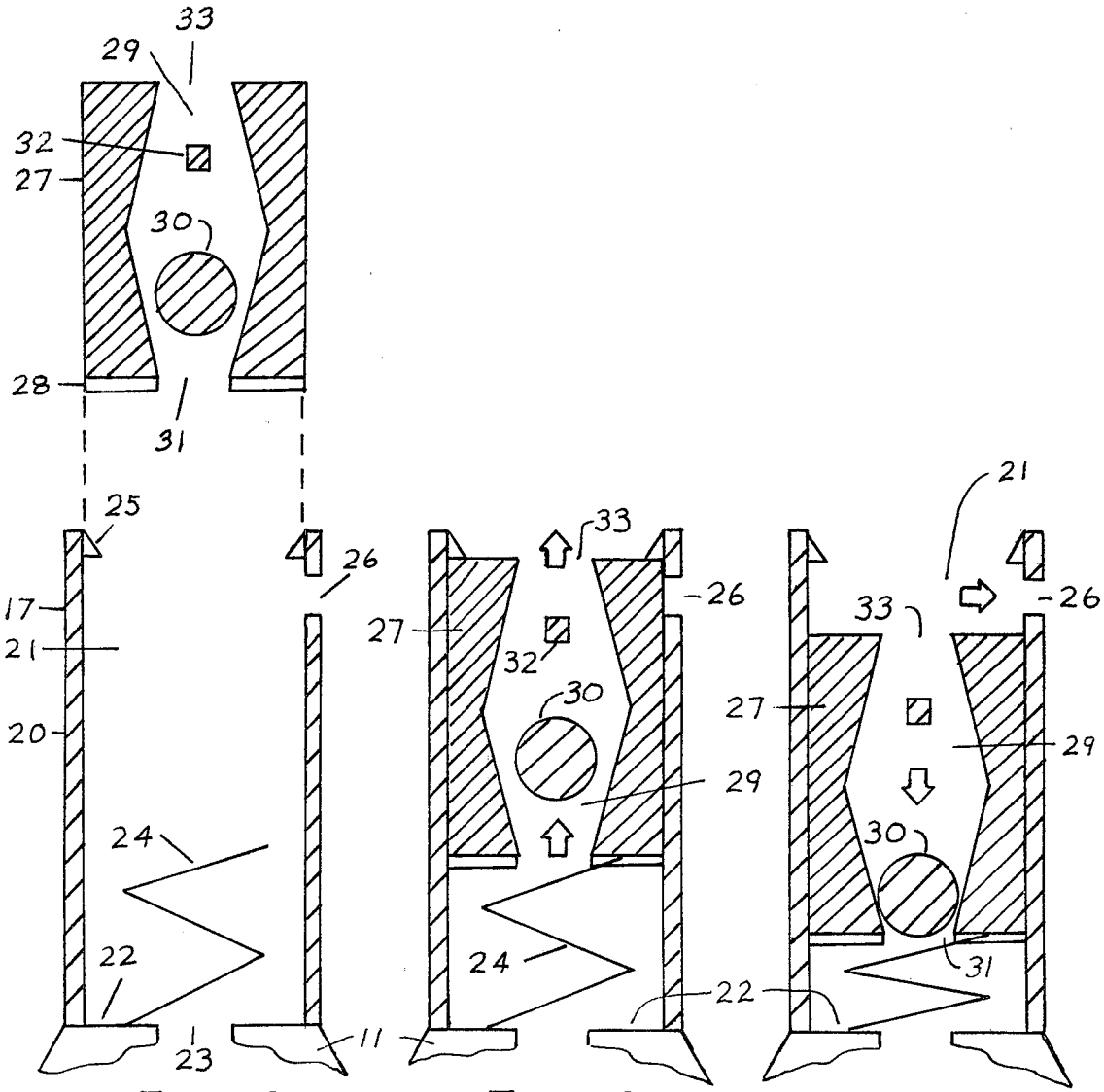
Fig. 3a Fig. 3b Fig. 3c

UNDERWATER BREATHING DEVICE

This present invention relates to underwater breathing devices. Presently available underwater breathing devices rely on a snorkel system for the conduction of surface air to the diver, or for the compression of breathable gas so that it might be taken, with reduced volume and buoyancy, below the surface of the water.

Snorkeling devices without compressors, though simple and inexpensive, are impractical at any but minimal depths because the pressure of the water makes normal inspiration increasingly difficult as the depth of the water, and the pressure increases. Snorkels with compression systems are usable at greater depths because inspiration is simplified. Scuba systems compress breathable gas for underwater breathing and avoid the use of a conduction system from the surface and except for the bulk of the storage tank, provide greater range and depth of use. However, the use of underwater breathing devices, whether compressed air conveyed underwater, or scuba equipment, causes the emitting of a breathable gas under the water, gas that may be captured and rebreathed as necessary.

Breathed air contains fair amounts of oxygen, but higher amounts of carbon dioxide than surface air, and though the gas is not ideal for breathing, it is acceptable for emergency use. The air may also be used for other purposes, for example, the filling of lift bags.

Air is expelled from scuba devices after it has been breathed. The expelled air has had some of the oxygen removed, and carbon dioxide has been added to it in the breathing process. Expelled bubbles are of variable size, but their size grows as the depth of the water decreases, meaning that the bubbles expand as they approach the surface of the water, as the pressure on the bubbles decreases.

The bubbles will grow in size reaching a diameter of about 30 centimeters. At approximately that diameter, the bubbles break into smaller bubbles, repeating the process as they rise.

An inverted inflexible container will not trap these bubbles because the volume of water contained therein is non-compressible and essentially non-movable. Bubbles reaching the plane of the opening of the container, in effect, hit an immovable wall that forces the bubbles along the plane, and the bubbles will roll off the plane and will travel in the direction of least resistance, off the edge of the plane and toward the surface. The trapped water within the rigid container will prevent the outside rising bubbles from being trapped within the container.

A flexible container omits this shortcoming and allows the bubbles to be trapped in the flexible container, since the mass of water within a flexible container is as non-rigid as water outside a rigid container.

The principal objective of this invention is to provide an effective means of capturing breathable gases that are available beneath the surface of water.

A further object is to provide a means for capturing breathable gases that are released from scuba devices, so that this gas may be re-breathed.

Another object of this invention is to provide an emergency underwater breathing device that captures breathable gases that are released from underwater sources.

Other objects and advantages of the invention will become better understood hereinafter from a consideration of the specifications with reference to the accompanying drawings forming part thereof, and in which like numerals correspond to like parts throughout the views of the invention and wherein:

FIG. 1 is an overview of the device;

FIG. 2 is a view of the device as it would be used by a diver;

FIG. 3 is a series of vertical cross-sectional views of the one-way valve with *3a*, the exploded vertical cross-sectional view of the operating parts of the valve; *3b* is the vertical cross-sectional view of the valve in operation as gas is fed through to the mouthpiece, and; *3c* is vertical cross-sectional view of the valve in operation as gas is fed into the valve for exit through the exhaust port.

Referring to the drawing FIG. 1, the underwater breathing device consists of the collection reservoir 11 which is capable of collecting gas bubbles from a liquid medium, and which is open at both ends and which is capable of being held in operational position by handle means 12. The gas intake opening 13, at one end, the wide end, of said reservoir 11, is maintained open by the intake open-aperature support means 14, which is essentially circular and which is capable of maintaining the opening and to which the handle means 12 is attached.

At essentially the opposite end of said reservoir 11 is the reservoir exhaust port 15, through which gas is extracted from said reservoir 11, which is connected to the gas extraction means 16, which contains the one-way valve system. The gas extraction means is suitable for withdrawing the collected gas from the collection reservoir 11. Gas therefore collects within said reservoir by passing said intake opening 13, and travels into said reservoir 11. From the reservoir, the gas passes into and through the gas extraction means 16 where it can be withdrawn by its operator and is subject to being breathed.

The flow of gas is determined by its natural movement in a liquid medium and by the means used to extract it.

Refering to FIG. 2, in operation, the underwater breathing device is held by the diver 18 who holds the said handle means 12 and takes the said gas extraction means 16 into his mouth. The device is then held in position between the diver's hands with said gas extraction means 16 held in the diver's mouth so that the contained gas 19 may be extracted by the diver and breathed. The gas may also be extracted and used for non-breathing uses such as filling containers as needed.

The intake opening 13 is positioned by the operator so that non-contained gas 20*a* may be collected into the collection reservoir as the gas rises in the liquid medium which surrounds both the diver and the collection reservoir.

Said collection reservoir 11, is a flexible, inflatable, expandable, non-rigid container, capable of changing its shape in response to the volume of the contained gas 19 and the pressure exerted thereupon, and therefore is adaptable to variations of volume of the gas and of pressure subject to the depth of operation.

Refering to FIG. *3a*, the exploded view of the said one-way valve within a valve 17, which is composed of the thin-walled valve housing 20 which surrounds the valve chamber 21 which contains at one end, the lower chamber block means 22 which is adjacent to the collection reservoir 11, said chamber block contains the valve intake port 23 which is alligned with the reservoir exhaust port 15. The said lower chamber block supports the attached spring means 24. Near the opposite end of said valve chamber 21 is the valve stop means 25 which is capable of limiting the upper range of motion of a chamber contained valve member. The exhaust port 26 is positioned within the valve housing 20 and is capable of connecting the valve chamber 21 with the liquid medium outside 10, subject to the position of a valve member.

Contained within the valve chamber 20 is the primary valve member 27 which reciprocates within said valve chamber 21, its range of motion being between valve stop means 25 at one limit of its motion, and on the opposite limit, by a spring means 24 which is interpositioned between the primary valve member 27 and the and the lower chamber block means 22. Said spring means 24 is capable of forcing the top of said primary valve member 27 to a position against the valve stop means 25. When the primary valve member 27 is against the valve stop 25, the said valve member 27 is capable of blocking the exhaust port 26.

Primary valve member 27 is capable of being positioned within said valve chamber 21 and said valve member 27 has connected around its lower edge, the primary valve member seal 28, which is capable of sealing said primary valve against the internal surface of said valve chamber 21, as said primary valve member may travel in a reciprocating manner within said valve chamber 21.

Within said primary valve member 27 is the hollow secondary valve chamber 29 which contains the valve element 30 which moves freely and is capable of resting against and sealing the lower aperature 31 which is located at the end of the valve member closest to the collection reservoir and at the lower end of the secondary valve chamber 29. Valve element range limit means 32 is connected to the valve member 27 and is capable of preventing said valve element 30 from sealing the upper aperature 32, (the farthest end of the valve member 27, from the collection reservoir) of the secondary valve chamber 29. Said valve element 30 is capable of sealing the lower aperature 31, but the valve element range limit means 32 is capable of preventing the said valve element 30 from sealing the upper aperature 33, allowing the secondary valve chamber to be sealed by gas flow in only one direction. Valve element 30 is contained within the secondary valve chamber 29.

The lower aperature 31 is of like shape as the valve member 30 so that said valve member 30 is capable of being forced against, and is thereby capable of closing the lower aperature 31.

Refering to FIG. 3*b*, the one-way valve system is shown as gas is withdrawn as during inhalation by the operator from the collection reservoir 11 and passes through the intake port 23, through the lower aperature 31 and into the secondary valve chamber 29. It displaces the valve element 30 allowing gas flow through the secondary valve chamber 29, out the upper aperature 33 and into the body of the gas extraction means 16 (FIG. 1), whereupon the gas can be withdrawn and used as needed.

Refering to FIG. 3*c*, the one-way valve system is shown during exhalation by the operator. Gas is forced through the upper aperature 33 and into the secondary valve chamber 29 whereupon the pressure of the forced gas, forces the valve element 30 against the lower aperature 31, thereby preventing the passage of gas through the lower aperature 31.

Because the lower aperature is effectively sealed closed by by the pressure, the pressure therefore forces the displacement of the primary valve member 27 within the valve chamber 21 and toward the chamber block means 22 and compressing the spring means 24. As the primary valve member 27 is displaced, the exhaust post 26 is exposed, allowing the pressure of the gas to to be released through said exhaust port 26.

The underwater breathing device is therefore capable of collecting breathable gas under water, as from the exhaust of a scuba system. The gas may be collected by the collection reservoir 11 which conducts such gas to the operator. The one-way valve allows the collected gas to be inhaled from said collection reservoir, then expelled through an exhaust port 26 rather than back into the reservoir.

Having thus described the invention, it is to be understood that certain modifications in the construction and arrangement of the parts will be made, as deemed necessary, without departing from the scope of the appended claims.

I claim the following:

1. An underwater breathing device comprising:

a non-rigid umbrella-like shaped reservoir which is capable of collecting rising gas from a liquid medium, said reservoir having a wide gas intake opening at one end and at essentially the apex end, a reservoir exhaust port through which gas is extracted from said reservoir, said exhaust port terminating in a breathing tube means.

2. An underwater breathing device comprising:

a non-rigid umbrella-like shaped reservoir which is capable of collecting rising gas from a liquid medium, said reservoir having a wide gas intake opening at one end and at essentially the apex end, a reservoir exhaust port through which gas is extracted from said reservoir, said exhaust port terminating in a breathing tube means, said exhaust port containing a one-way valve means suitable for withdrawing collected gas from said collection reservoir, subject to being breathed by its operator.

3. An underwater breathing device as defined in claim 2 wherein said one-way valve means comprises the combination of:

a valve housing chamber therein having one end communicating with said reservoir and an opposite end communicating with said breathing means, said valve housing having at one end a lower chamber block means which contains a valve intake port, a spring means in said valve chamber supported by said lower chamber block means, a valve stop means in said valve chamber adjacent the opposite end thereof, an exhaust port which is positioned adjacent said valve stop means within the valve housing and is capable of connecting the valve chamber with a liquid medium outside, a primary valve member slidably mounted within said valve chamber, interpositioned between said valve stop means and said spring means, said primary valve member reciprocates within said valve chamber, its range of motion being between said valve stop means and said spring means, said spring means being capable of forcing the top of said primary valve member to a position against said valve stop means, when in said position, said valve member blocks said exhaust port, a secondary valve chamber in said primary valve chamber defining a flow path therethrough and having an inlet opening defining a valve seat communicating with said one end of said valve chamber and an outlet opening, a secondary valve element in said secondary valve chamber which moves freely and is capable of blocking said valve seat of said secondary valve chamber, said secondary valve chamber also contains a valve element range limit means which is capable of preventing said valve element from sealing the outlet opening of the said secondary valve chamber, allowing the said secondary valve chamber to be sealed by gas flow in only one direction, by gas flow from the outlet opening to the inlet opening, said gas flow which seals the inlet opening, forcing the displacement of the primary valve member within the valve chamber toward the chamber block means, compressing the spring means and exposing the exhaust port, allowing the pressure of the gas to be released through said exhaust port, when gas withdrawn, as during inhalation by the operator, passes through the intake port, through the inlet opening into the secondary valve chamber, it displaces the valve element, allowing gas flow through the secondary valve chamber and out the outlet opening, thereby allowing gas to flow from the inlet opening to the outlet opening.

* * * * *